US012590442B2

(12) United States Patent
Takenaka

(10) Patent No.: US 12,590,442 B2
(45) Date of Patent: Mar. 31, 2026

(54) CONTROL SYSTEM AND CONTROL METHOD FOR WORK MACHINE

(71) Applicant: KOMATSU LTD., Tokyo (JP)

(72) Inventor: Yuita Takenaka, Tokyo (JP)

(73) Assignee: KOMATSU LTD., Tokyo (JP)

( * ) Notice: Subject to any disclaimer, the term of this patent is extended or adjusted under 35 U.S.C. 154(b) by 52 days.

(21) Appl. No.: 18/699,708

(22) PCT Filed: Sep. 9, 2022

(86) PCT No.: PCT/JP2022/033888
§ 371 (c)(1),
(2) Date: Apr. 9, 2024

(87) PCT Pub. No.: WO2023/067943
PCT Pub. Date: Apr. 27, 2023

(65) Prior Publication Data

US 2025/0237038 A1 Jul. 24, 2025

(30) Foreign Application Priority Data

Oct. 22, 2021 (JP) ..... 2021-172935

(51) Int. Cl.
*E02F 9/22* (2006.01)
*E02F 3/43* (2006.01)
*E02F 9/08* (2006.01)

(52) U.S. Cl.
CPC ..... *E02F 9/2207* (2013.01); *E02F 3/434* (2013.01); *E02F 9/0841* (2013.01)

(58) Field of Classification Search
CPC ..... E02F 9/2207; E02F 3/434; E02F 9/0841
See application file for complete search history.

(56) References Cited

U.S. PATENT DOCUMENTS 10,421,400 B2 * 9/2019 Imaizumi ..... H04N 7/18
10,597,845 B2 3/2020 Kenkel et al.
2003/0209134 A1 * 11/2003 Tabor ..... E02F 3/405 91/275
2009/0038186 A1 * 2/2009 Osswald ..... B62D 49/085 37/468

(Continued)

FOREIGN PATENT DOCUMENTS

EP 2 674 533 B1 9/2019
EP 4 101 990 A1 12/2022

(Continued)

*Primary Examiner* — Keith D Bloomquist
(74) *Attorney, Agent, or Firm* — Faegre Drinker Biddle & Reath LLP

(57) ABSTRACT

Provided are a control system and a control method for a work machine, by which a bucket shake operation can be performed and a load applied to a vehicular body can be reduced. The control system for a work machine includes: a rear frame; a front frame connected to the rear frame to be bendable with respect to the rear frame; a bucket that is operable with respect to the front frame; an actuator that drives the bucket; a sensor that detects a relative position between the rear frame and the front frame; and a work implement controller that controls the actuator. The work implement controller receives an input of a result of detection by the sensor, and controls an operation of the actuator based on the result of detection by the sensor.

12 Claims, 11 Drawing Sheets

(56) References Cited

U.S. PATENT DOCUMENTS

| | | | | |
|---|---|---|---|---|
| 2018/0100290 | A1* | 4/2018 | Greer | F15B 11/16 |
| 2021/0230838 | A1 | 7/2021 | Wu et al. | |
| 2022/0412050 | A1* | 12/2022 | Hoaby | E02F 9/2012 |
| 2023/0129066 | A1* | 4/2023 | Yamawaki | E02F 3/38 414/701 |

FOREIGN PATENT DOCUMENTS

| | | | |
|---|---|---|---|
| JP | 2008-101345 | A | 5/2008 |
| JP | 2012-86619 | A | 5/2012 |
| JP | 2019-49150 | A | 3/2019 |
| JP | 2021-155980 | A | 10/2021 |
| WO | 2021/193321 | A1 | 9/2021 |

* cited by examiner

FIG.7

| | ARTICULATION ANGLE (ABSOLUTE VALUE) | | |
|---|---|---|---|
| | 0 DEGREE (TRAVELING STRAIGHT) | 20 DEGREES | 40 DEGREES (MAXIMUM) |
| BUCKET SHAKABLE FREQUENCY (TARGET VALUE) | LARGE | INTERMEDIATE | SMALL |
| ALLOWABLE RATE OF CHANGE IN FLOW RATE [%/msec] | LARGE | INTERMEDIATE | SMALL |

FIG.11

| | ARTICULATION ANGLE (ABSOLUTE VALUE) | | |
|---|---|---|---|
| | 0 DEGREE (TRAVELING STRAIGHT) | 20 DEGREES | 40 DEGREES (MAXIMUM) |
| MAXIMUM ALLOWABLE FLOW RATE [%] | LARGE | INTERMEDIATE | SMALL |

CONTROL SYSTEM AND CONTROL METHOD FOR WORK MACHINE

TECHNICAL FIELD

The present disclosure relates to a control system and a control method for a work machine.

BACKGROUND ART

In a work machine equipped with a work implement including a bucket in front of a vehicular body, mud and the like may adhere to the bucket during work using the bucket. The work machine may be manipulated to quickly vibrate the bucket (hereinafter referred to as "bucket shake") in order to cause adhering matter to fall off from the bucket. U.S. Pat. No. 10,597,845 (PTL 1) discloses a work implement vibration system targeted for a vehicle including a work implement.

CITATION LIST

Patent Literature

PTL 1: U.S. Pat. No. 10,597,845

SUMMARY OF INVENTION

Technical Problem

In a work machine, when bucket shake is performed while a vehicular body is in an unstable state, a load applied to the vehicular body may increase.

The present disclosure proposes a control system and a control method for a work machine, by which a bucket shake operation can be performed and a load applied to a vehicular body can be reduced.

Solution to Problem

A control system for a work machine according to an aspect of the present disclosure includes: a rear frame; a front frame connected to the rear frame to be bendable with respect to the rear frame; a bucket that is operable with respect to the front frame; an actuator that drives the bucket; a sensor that detects a relative position between the rear frame and the front frame; and a controller that controls the actuator. The controller receives an input of a result of detection by the sensor and controls an operation of the actuator based on the result of detection by the sensor.

Advantageous Effects of Invention

According to the control system and the control method for the work machine of the present disclosure, the bucket shake operation can be performed and the load applied to the vehicular body can be reduced.

BRIEF DESCRIPTION OF DRAWINGS

FIG. 7 is a diagram showing a rate of change in a flow rate of hydraulic oil supplied to a bucket cylinder with respect to an articulation angle.

FIG. 11 is a diagram showing a maximum allowable flow rate of hydraulic oil supplied to a bucket cylinder with respect to an articulation angle according to a third embodiment.

DESCRIPTION OF EMBODIMENTS

Figure 1:
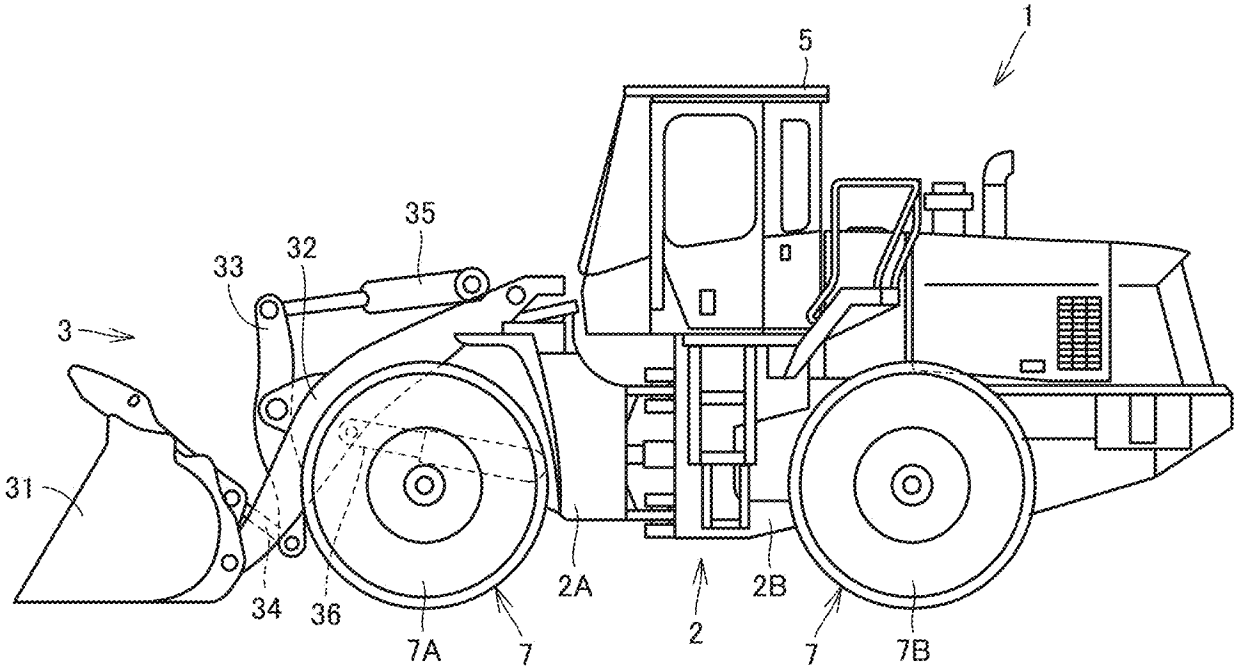
FIG. 1 is a side view of a wheel loader as an example of a work machine according to an embodiment.

Embodiments will be hereinafter described with reference to the accompanying drawings. In the following description, the same components are denoted by the same reference characters. Their names and functions are also the same. Accordingly, the detailed description thereof will not be repeated.

First Embodiment

<Overall Configuration of Wheel Loader 1>

In an embodiment, a wheel loader 1 will be hereinafter described as an example of a work machine. FIG. 1 is a side view of wheel loader 1 as an example of the work machine according to the embodiment.

As shown in FIG. 1, wheel loader 1 includes a vehicular body frame 2, a work implement 3, a traveling unit 7, and a cab 5. Vehicular body frame 2, cab 5 and the like constitute a vehicular body (a work machine body) of wheel loader 1. Work implement 3 and traveling unit 7 are attached to the vehicular body of wheel loader 1.

Traveling unit 7 causes the vehicular body of wheel loader 1 to travel and includes running wheels 7A and 7B. Wheel loader 1 is a wheeled vehicle including running wheels 7A and 7B as rotating bodies for traveling on both sides of the vehicular body in a left-right direction. Wheel loader 1 is movable as running wheels 7A and 7B are rotationally driven, and also, can perform a desired work using work implement 3.

In the present specification, the direction in which wheel loader 1 travels straightforward is referred to as a front-rear direction of wheel loader 1. In the front-rear direction of wheel loader 1, the side where work implement 3 is located with respect to vehicular body frame 2 is referred to as a frontward direction, and the side opposite to the frontward direction is referred to as a rearward direction. The left-right direction of wheel loader 1 is orthogonal to the front-rear direction in a plan view of wheel loader 1 situated on a flat ground. The right side and the left side in the left-right direction in facing forward are defined as a right direction and a left direction, respectively. A top-bottom direction of wheel loader 1 is orthogonal to a plane defined by the front-rear direction and the left-right direction. In the top-bottom direction, the ground side is defined as a lower side and the sky side is defined as an upper side.

Vehicular body frame 2 includes a front frame 2A and a rear frame 2B. Front frame 2A is disposed in front of rear frame 2B. Front frame 2A is connected to rear frame 2B so as to be bendable with respect to rear frame 2B. Front frame 2A and rear frame 2B constitute vehicular body frame 2 having an articulated structure. Wheel loader 1 is an articulate-type work machine in which front frame 2A and rear frame 2B are coupled to each other.

Work implement 3 and a pair of left and right running wheels (front wheels) 7A are attached to front frame 2A. Work implement 3 is disposed on the front side of the vehicular body and is supported by the vehicular body of wheel loader 1. Work implement 3 includes a boom 32 and a bucket 31. Bucket 31 is disposed at the distal end of work implement 3. Bucket 31 is a work tool for excavation and loading.

Work implement 3 includes a boom cylinder 36. Front frame 2A and boom 32 are coupled to each other by a pair of boom cylinders 36. Each boom cylinder 36 has a proximal end attached to front frame 2A and a distal end attached to boom 32. Boom cylinder 36 is a hydraulic actuator that moves boom 32 up and down with respect to front frame 2A. As boom 32 is raised and lowered, bucket 31 attached to the distal end of boom 32 is also raised and lowered.

Work implement 3 further includes a bell crank 33, a coupling link 34, and a bucket cylinder 35. Bell crank 33 is supported by boom 32 substantially at the center of boom 32 so as to be rotatable. Bucket cylinder 35 couples bell crank 33 and front frame 2A. Coupling link 34 is coupled to a distal end portion of bell crank 33. Coupling link 34 couples bell crank 33 and bucket 31.

Bucket cylinder 35 has a proximal end attached to front frame 2A. Bucket cylinder 35 has a distal end attached to a proximal end portion of bell crank 33. Bucket cylinder 35 is a hydraulic actuator that causes bucket 31 to pivot up and down with respect to boom 32. Bucket cylinder 35 is a work tool cylinder that drives bucket 31. Bucket 31 is configured to be operable with respect to boom 32. Bucket 31 is configured to be operable with respect to front frame 2A.

Cab 5 in which an operator is seated and a pair of left and right running wheels (rear wheels) 7B are attached to rear frame 2B. Box-shaped cab 5 is disposed behind boom 32. Cab 5 is placed on vehicular body frame 2. A seat on which an operator sits, a manipulation device (described later), and the like are disposed inside cab 5. Cab 5 may be mounted on front frame 2A.

<System Configuration>

Figure 2:
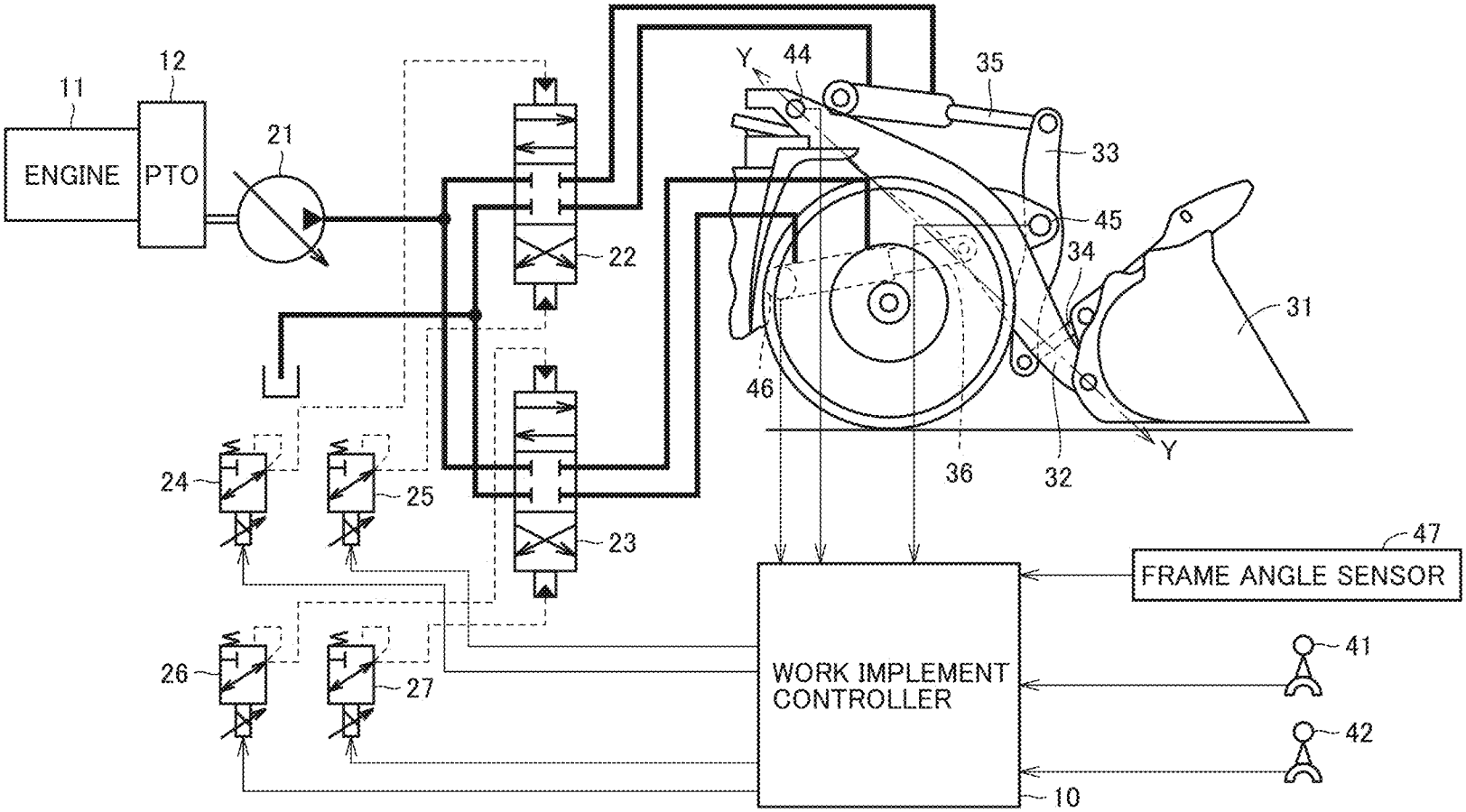
FIG. 2 is a schematic block diagram showing a configuration of an overall system including a wheel loader.

FIG. 2 is a schematic block diagram showing a configuration of an overall system including wheel loader 1 according to the embodiment. Wheel loader 1 includes a work implement controller 10, an engine 11, and a power take-off (PTO) 12.

Engine 11 serves as a driving source that generates driving force for driving work implement 3 and is, for example, a diesel engine. The output of engine 11 is controlled by adjusting the amount of fuel injected into a cylinder of engine 11. PTO 12 distributes the output of engine 11 to a traveling system for driving traveling unit 7 and a hydraulic system for driving work implement 3. Engine 11, PTO 12, and the hydraulic system are mounted at rear frame 2B and behind cab 5.

The hydraulic system serves as a mechanism mainly for driving work implement 3 (for example, boom 32 and bucket 31). The hydraulic system includes: a hydraulic pump 21 for a work implement driven by PTO 12; a hydraulic pilot-type bucket control valve 22 and a hydraulic pilot-type boom control valve 23 provided in a discharge circuit of hydraulic pump 21; electromagnetic proportional control valves 24 and 25 for a bucket that are connected to respective pilot pressure receiving portions of bucket control valve 22; and electromagnetic proportional control valves 26 and 27 for a boom that are connected to respective pilot pressure receiving portions of boom control valve 23.

Work implement 3 is driven by hydraulic oil from hydraulic pump 21. Hydraulic pump 21 is driven by engine 11 to discharge hydraulic oil for operating work implement 3. As boom cylinder 36 extends and retracts by receiving hydraulic oil supplied from hydraulic pump 21, boom 32 is raised and lowered. As bucket cylinder 35 extends and retracts by receiving hydraulic oil supplied from hydraulic pump 21, bucket 31 pivots up and down.

Electromagnetic proportional control valves 24 to 27 are connected to a pilot pump (not shown) and control supply of hydraulic oil from the pilot pump to each of the pilot pressure receiving portions of boom control valve 23 and bucket control valve 22 in response to a control signal from work implement controller 10.

Specifically, electromagnetic proportional control valve 24 switches bucket control valve 22 to cause bucket cylinder 35 to retract such that bucket 31 moves in a dump direction (the direction in which the cutting edge of bucket 31 is lowered). Further, electromagnetic proportional control valve 25 switches bucket control valve 22 to cause bucket cylinder 35 to extend such that bucket 31 moves in a tilt direction (the direction in which the cutting edge of bucket 31 is raised).

Electromagnetic proportional control valve 26 switches boom control valve 23 to causes boom cylinder 36 to retract such that boom 32 is lowered. Electromagnetic proportional control valve 27 switches boom control valve 23 to cause boom cylinder 36 to extend such that boom 32 is raised.

A manipulation device, a boom angle sensor 44, a bucket angle sensor 45, a boom bottom pressure sensor 46, and a frame angle sensor 47 are connected to work implement controller 10. The manipulation device is provided in cab 5. The manipulation device includes a boom control lever 41 and a bucket control lever 42. The manipulation device also includes a steering handle, a steering lever, an accelerator pedal, and the like (not shown).

Boom control lever 41 is disposed, for example, on the right side of the seat inside cab 5. Boom control lever 41 incorporates a lever angle sensor that detects a lever angle. Boom control lever 41 can be manually manipulated by an operator so as to operate boom 32. When the operator manipulates boom control lever 41, the lever angle sensor detects the lever angle corresponding to the amount of manipulation and outputs the detected lever angle to work implement controller 10 as a boom lever signal.

Bucket control lever 42 is disposed, for example, on the right side of the seat inside cab 5. Bucket control lever 42 incorporates a lever angle sensor that detects a lever angle. Bucket control lever 42 is manually operable by the operator to operate bucket 31. When the operator manipulates bucket control lever 42, the lever angle sensor detects the lever angle corresponding to the amount of manipulation, and outputs the detected lever angle to work implement controller 10 as a bucket lever signal.

Boom control lever 41 and bucket control lever 42 may be separate levers. Alternatively, one lever may have both functions of boom control lever 41 and bucket control lever 42. For example, the manipulation to move the lever in the front-rear direction may be set as a manipulation to move boom 32 up and down, and the manipulation to move the lever in the left-right direction may be set as a manipulation to cause bucket 31 to pivot.

Boom angle sensor 44 is configured, for example, of a rotary encoder and the like provided at an attachment portion (a support shaft) of boom 32 at which boom 32 is attached to vehicular body frame 2, detects the boom angle between a center line of boom 32 and a horizontal line, and then outputs a detection signal. In this case, the center line of boom 32 is a Y-Y line in FIG. 2 that is a line of connection between the attachment portion of boom 32 (the center of the support shaft) at which boom 32 is attached to vehicular body frame 2 and an attachment portion of bucket 31 (the center of a bucket support shaft). When the Y-Y line in FIG. 2 extends along the horizontal line, boom angle sensor 44 outputs a boom angle of 0 degree. When the tip end of boom 32 is raised from the state of the boom angle of 0 degree, boom angle sensor 44 outputs a positive value. When the tip end of boom 32 is lowered, boom angle sensor 44 outputs a negative value.

Bucket angle sensor 45 is configured, for example, of a rotary encoder and the like provided at a rotary shaft of bell crank 33. Bucket angle sensor 45 outputs 0 degree when the cutting edge of bucket 31 is located horizontally on the ground in the state in which bucket 31 is on the ground, outputs a positive value when bucket 31 is moved in the tilt direction (upward), and outputs a negative value when bucket 31 is moved in the dump direction (downward).

Boom bottom pressure sensor 46 detects a pressure on the bottom side of boom cylinder 36 (a boom bottom pressure). The boom bottom pressure rises when bucket 31 carries a load, and lowers when bucket 31 carries no load.

Frame angle sensor 47 is provided in a bending mechanism for bending front frame 2A with respect to rear frame 2B. Frame angle sensor 47 detects a relative position between rear frame 2B and front frame 2A. Front frame 2A is bent with respect to rear frame 2B by extending and retracting an articulate cylinder coupled to front frame 2A and rear frame 2B. The articulate cylinder is a hydraulic actuator driven by hydraulic pressure to change the angle at which front frame 2A is bent with respect to rear frame 2B.

Figure 3:
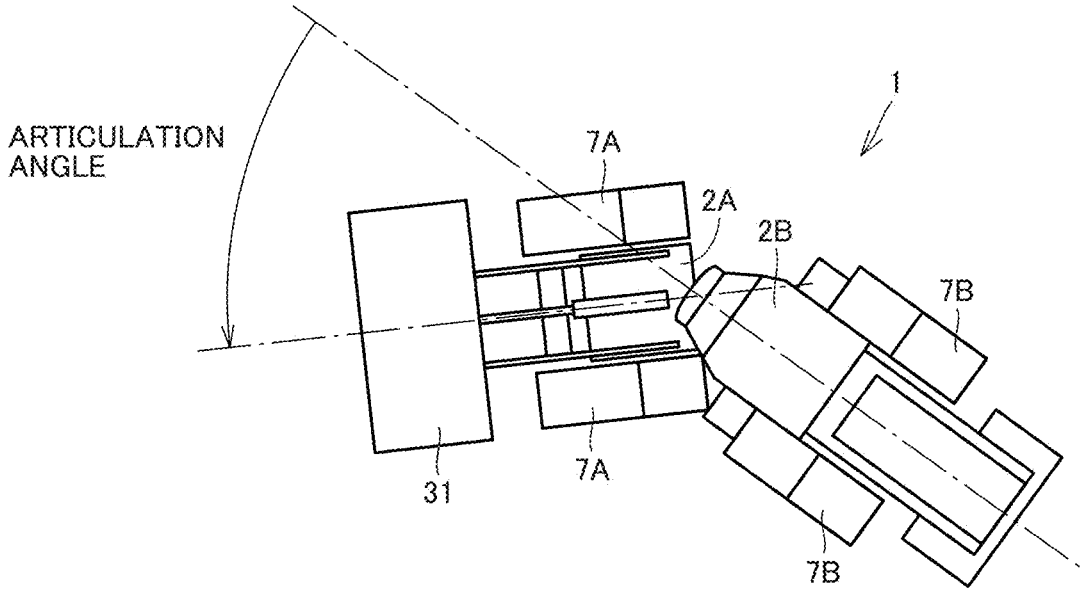
FIG. 3 is a schematic plan view of the wheel loader in an articulated state.

FIG. 3 is a schematic plan view of wheel loader 1 in the articulated state. Frame angle sensor 47 detects an articulation angle shown in FIG. 3, at which front frame 2A is bent with respect to rear frame 2B, and then outputs a detection signal to work implement controller 10. When wheel loader 1 travels straight, frame angle sensor 47 outputs an articulation angle of 0 degree.

<Configuration of Work Implement Controller 10>

Figure 4:
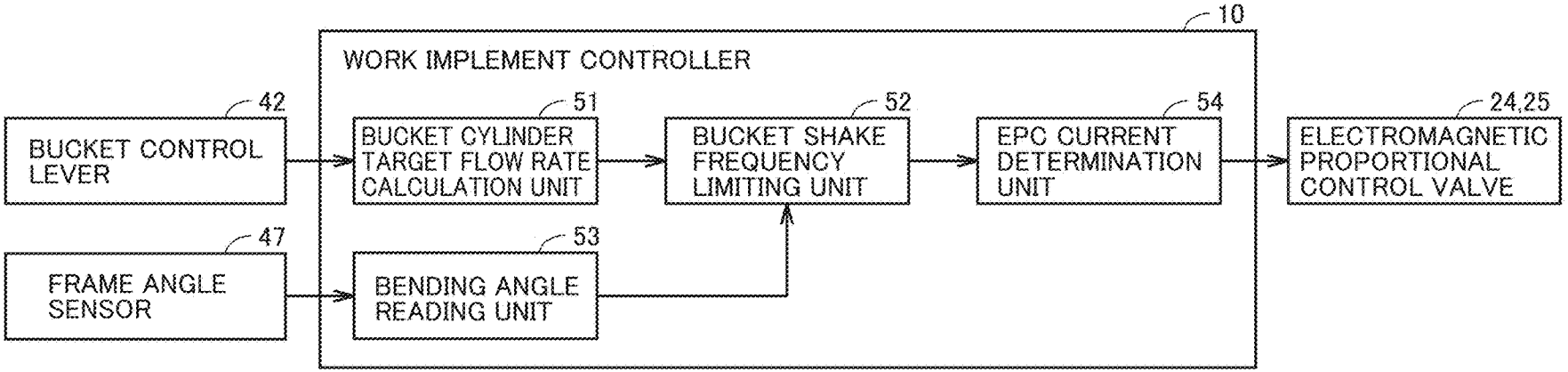
FIG. 4 is a block diagram showing a functional configuration of a work implement controller.

FIG. 4 is a block diagram showing a functional configuration of work implement controller 10. As shown in FIG. 4, work implement controller 10 mainly includes a bucket cylinder target flow rate calculation unit 51, a bucket shake frequency limiting unit 52, a bending angle reading unit 53, and an EPC current determination unit 54.

From the lever angle sensor of bucket control lever 42, bucket cylinder target flow rate calculation unit 51 receives an input of the bucket lever signal indicating the result of detection of the amount of manipulation of bucket control lever 42. Based on the bucket lever signal, bucket cylinder target flow rate calculation unit 51 calculates a target flow rate of the hydraulic oil supplied to bucket cylinder 35 for driving bucket 31. Bucket cylinder target flow rate calculation unit 51 outputs the calculated target flow rate of the hydraulic oil to bucket shake frequency limiting unit 52.

From frame angle sensor 47, bending angle reading unit 53 receives an input of a signal indicating the result of detection of the articulation angle at which front frame 2A is bent with respect to rear frame 2B. Bending angle reading unit 53 reads the articulation angle based on the signal input from frame angle sensor 47. Bending angle reading unit 53 outputs the result of detection of the articulation angle to bucket shake frequency limiting unit 52.

Based on the result of detection of the articulation angle, bucket shake frequency limiting unit 52 controls the operation of bucket cylinder 35 according to the contents of manipulation of bucket control lever 42. Specifically, bucket shake frequency limiting unit 52 changes the limit value for the movement of bucket 31 according to the magnitude of the articulation angle. More specifically, bucket shake frequency limiting unit 52 sets the allowable number of times per unit time of the bucket shake operation to rapidly vibrate bucket 31 such that the allowable number of times becomes smaller as the articulation angle is larger. According to the articulation angle, bucket shake frequency limiting unit 52 changes the maximum frequency at which the operator can manipulate bucket control lever 42 in order to perform the bucket shake operation. Bucket shake frequency limiting unit 52 determines a command flow rate of the hydraulic oil supplied to bucket cylinder 35, in which the command flow rate corresponds to the magnitude of the articulation angle. Then, bucket shake frequency limiting unit 52 outputs the determined command flow rate to EPC current determination unit 54.

EPC current determination unit 54 determines a control signal (an EPC current) corresponding to the command flow rate of the hydraulic oil supplied to bucket cylinder 35. EPC current determination unit 54 outputs the EPC current to electromagnetic proportional control valves 24 and 25 for bucket that are connected to bucket control valve 22.

<Control of Bucket Shake Operation>

Figure 5:
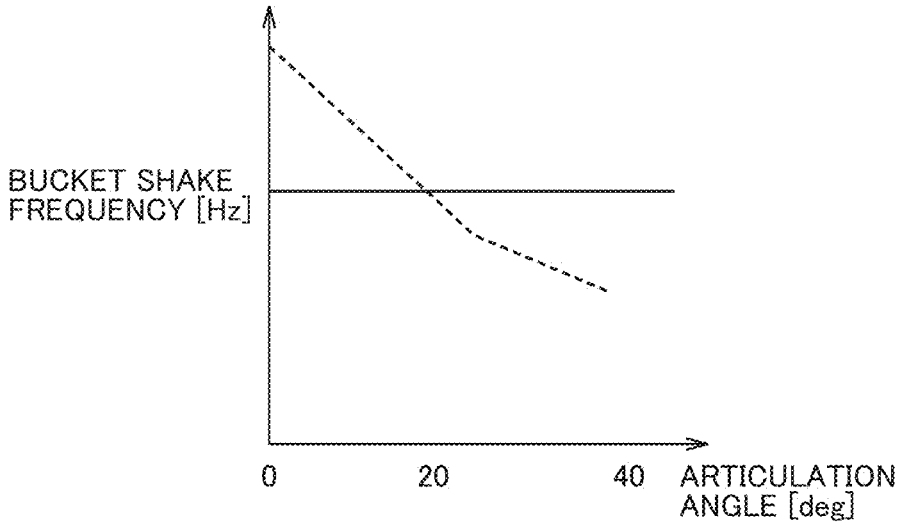
FIG. 5 is a diagram showing control of a conventional bucket shake operation.

FIG. 5 is a diagram showing control of a conventional bucket shake operation. In FIG. 5, the horizontal axis represents the articulation angle while the vertical axis represents the frequency at which the operator manipulates bucket control lever 42 (the number of times of manipulation per second).

A dashed line in FIG. 5 indicates a limit frequency at which the vehicular body of wheel loader 1 resonates in the roll direction as the bucket shake is performed. When the bucket shake is performed in the state in which front frame 2A is bent with respect to rear frame 2B, a reaction force in the roll direction is applied to rear frame 2B from bucket 31 through boom 32, bucket cylinder 35, and front frame 2A, and thus, rear frame 2B swings in the roll direction.

Wheel loader 1 is less influenced by swing in the pitch direction since the vehicular body is long in the front-rear direction, but is more influenced by swing in the roll direction since the vehicular body is short in width in the left-right direction. Thus, in wheel loader 1, a natural frequency with respect to swing is generally higher in the roll direction than in the pitch direction. Since the swing of the vehicular body of wheel loader 1 in the roll direction is close to the frequency of the vibration of bucket 31, the vehicular body is more likely to resonate with the vibration of bucket 31. As a result, the vehicular body of wheel loader 1 swings more significantly in the roll direction than in the pitch direction. As shown in FIG. 5, the larger articulation angle leads to a smaller limit frequency at which the vehicular body of wheel loader 1 resonates in the roll direction with respect to the bucket shake.

A solid line in FIG. 5 indicates a conventional limit value of the frequency at which the operator manipulates bucket control lever 42. Conventionally, irrespective of the magnitude of the articulation angle, the allowable number of times per unit time of the operation to vibrate the bucket is set to be constant. Even when the articulation angle was sufficiently small and thus resonance was less likely occur, the movement of bucket 31 was limited, which made it difficult to perform the operation to remove the adhering matter from bucket 31 by the bucket shake, with the result that the workability decreased. Further, in the state in which the articulation angle was large, the manipulation at a frequency higher than the limit frequency at which resonance occurred was allowed, which raised the possibility that the vehicular body might significantly vibrate in the roll direction.

Figure 6:
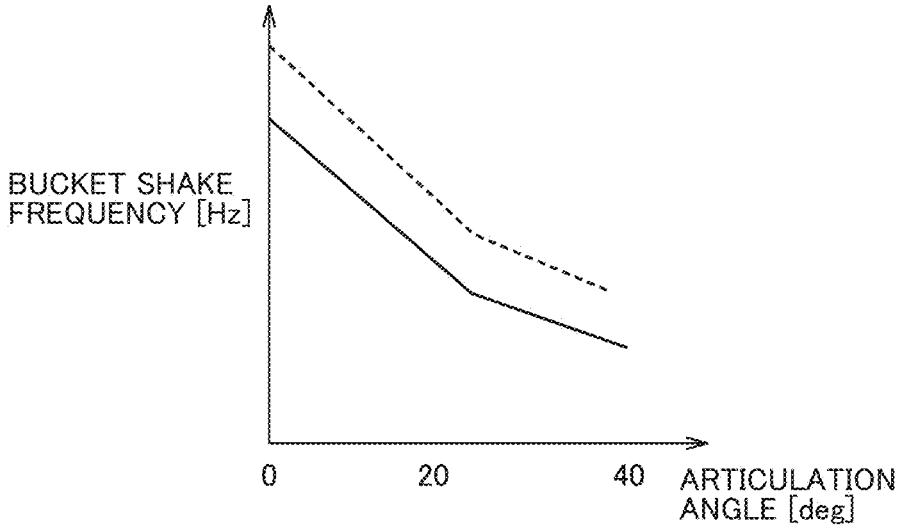
FIG. 6 is a diagram showing control of a bucket shake operation in the embodiment.

FIG. 6 is a diagram showing control of the bucket shake operation in the embodiment. Similarly to FIG. 5, in FIG. 6, the horizontal axis represents the articulation angle while the vertical axis represents the frequency (the number of times of manipulation per second) at which the operator manipulates bucket control lever 42. A dashed line in FIG. 6 indicates a limit frequency at which the vehicular body of wheel loader 1 resonates in the roll direction as the bucket shake is performed, as in FIG. 5.

A solid line in FIG. 6 indicates a limit value of the frequency at which the operator manipulates bucket control lever 42 in the present embodiment. As shown in FIG. 6, in the present embodiment, the limit value of the movement of bucket 31 is changed according to the magnitude of the articulation angle. The maximum frequency at which bucket control lever 42 can be manipulated for bucket shake is changed according to the articulation angle. Specifically, as the articulation angle is larger, the allowable number of times per unit time of the bucket shake is set to be smaller. In order to avoid resonance, the allowable number of times of the bucket shake is set to be smaller than a resonating frequency indicated by the dashed line in FIG. 6 so as to allow for a margin with respect to the resonating frequency.

When wheel loader 1 travels straight, resonance is less likely to occur, and thus, bucket shake at a high frequency is allowed. Thereby, adhering matter can be efficiently removed from bucket 31. When the bucket shake is performed in the state in which front frame 2A is bent with respect to rear frame 2B, rear frame 2B may resonate in the roll direction at a lower frequency. Thus, the frequency at which the bucket shake can be performed is lowered according to the angle of the vehicular body frame. By limiting the movement of bucket 31 when the articulation angle is large, occurrence of the resonance of the vehicular body can be suppressed, so that the load applied to the vehicular body can be reduced.

The diagram of the relation between the articulation angle and the bucket shake frequency shown in FIG. 6 is stored in advance in work implement controller 10 (FIGS. 2 and 4). From frame angle sensor 47, bending angle reading unit 53 receives an input of the result of detection by frame angle sensor 47. From bucket control lever 42, bucket cylinder target flow rate calculation unit 51 receives an input of the result of detection of the amount of manipulation of bucket control lever 42. From the relation diagram shown in FIG. 6 and stored in advance, bucket shake frequency limiting unit 52 reads the allowable number of times per unit time of the bucket shake based on the articulation angle. When the number of times per unit time of the bucket shake according to the contents of manipulation of bucket control lever 42 is greater than the allowable number of times based on the articulation angle, bucket shake frequency limiting unit 52 limits the operation of bucket cylinder 35 to thereby reduce the amplitude of the vibration of bucket 31 so as to be smaller than the contents of manipulation of bucket control lever 42.

FIG. 7 is a diagram showing a rate of change in the flow rate of the hydraulic oil supplied to bucket cylinder 35 with respect to the articulation angle. Changing the upper limit value of the frequency of swing of bucket 31 according to the articulation angle can be done, for example, by limiting the rate of change in the flow rate of the hydraulic oil supplied to bucket cylinder 35.

For example, a table shown in FIG. 7 is stored in advance in work implement controller 10, the table including: bucket shakable frequencies and allowable values of the rate of change in the flow rate of the hydraulic oil supplied to bucket cylinder 35, at the articulation angles of 0 degree, 20 degrees, and 40 degrees.

As the articulation angle is larger, the rate of change in the flow rate of the hydraulic oil supplied to bucket cylinder 35 is set to be smaller. In the state of traveling straight at an articulate angle of 0 degree, the bucket shakable frequency is set at a "large" value as a relatively large level, and the allowable value of the rate of change in the flow rate of the hydraulic oil is also set at a "large" value as a relatively large level. When the articulation angle is 20 degrees as a medium level, the bucket shakable frequency is set at an "intermediate" value as a medium level, and the allowable value of the rate of change in the flow rate of the hydraulic oil is also set at an "intermediate" value as a medium level. When the articulation angle is 40 degrees as a maximum level, the bucket shakable frequency is set at a "small" value as a relatively small level, and the allowable value of the rate of change in the flow rate of the hydraulic oil is also set at a "small" value as a relatively small level.

In practice, specific numerical values are stored in advance in work implement controller 10, in which the specific numerical values include the bucket shakable frequencies and the allowable rate of change in flow rate at the articulation angles of 0 degree, 20 degrees, and 40 degrees. In the case where the articulation angle is greater than 0 degree and less than 20 degrees and is greater than 20 degrees and less than 40 degrees, linear interpolation is applied to determine specific numerical values of the bucket shakable frequency and the allowable rate of change in flow rate. Note that the bucket shakable frequency is a set value related to the manipulation of bucket control lever 42 by the operator, and thus, is set at a value of about several Hertz.

Figure 8:
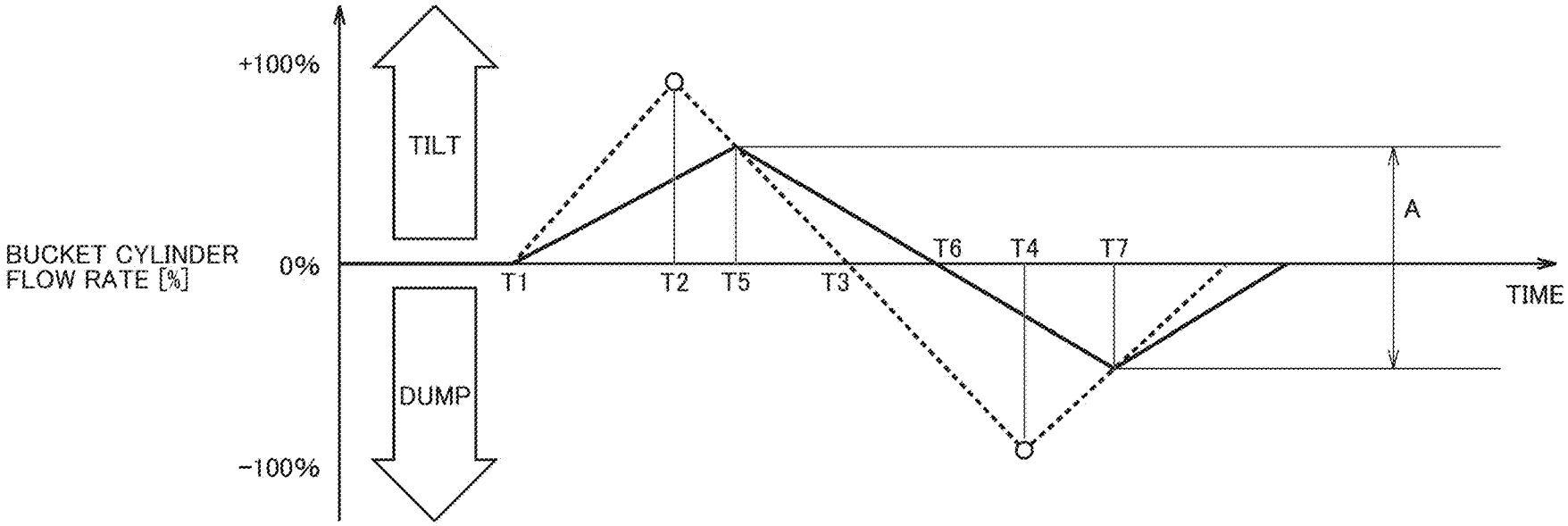
FIG. 8 is a diagram showing the flow rate of the hydraulic oil supplied to the bucket cylinder during a bucket shake operation.

FIG. 8 is a diagram showing the flow rate of hydraulic oil supplied to bucket cylinder 35 during the bucket shake operation. In FIG. 8, the horizontal axis represents time while the vertical axis represents the flow rate of the hydraulic oil supplied to bucket cylinder 35. In FIG. 8, "0%" indicates the state in which bucket control lever 42 is neutral, bucket 31 is in a standstill, and the supply of hydraulic oil to bucket cylinder 35 is in a standstill.

The positive direction of the vertical axis in FIG. 8 indicates the flow rate of the hydraulic oil supplied to a bottom-side oil chamber of bucket cylinder 35 so as to move bucket 31 in the tilt direction. In FIG. 8, "+100%" is the maximum value of the flow rate of the hydraulic oil supplied to bucket cylinder 35 so as to move bucket 31 in the tilt direction. The negative direction of the vertical axis in FIG. 8 indicates the flow rate of the hydraulic oil supplied to a head-side oil chamber of bucket cylinder 35 so as to move bucket 31 in the dump direction. Further in FIG. 8, "−100%"

is the maximum value of the flow rate of the hydraulic oil supplied to bucket cylinder 35 so as to move bucket 31 in the dump direction.

A dashed line in FIG. 8 indicates a target flow rate of the hydraulic oil determined by the operator's manipulation of bucket control lever 42. The target flow rate of the hydraulic oil shown by the dashed line in FIG. 8 is the flow rate of the hydraulic oil that is calculated by bucket cylinder target flow rate calculation unit 51 and then input from bucket cylinder target flow rate calculation unit 51 to bucket shake frequency limiting unit 52.

A solid line in FIG. 8 indicates the command flow rate of the hydraulic oil after the rate of change in the flow rate of the hydraulic oil has been limited. The command flow rate of the hydraulic oil indicated by the solid line in FIG. 8 is the flow rate of the hydraulic oil that is limited by bucket shake frequency limiting unit 52 and then input from bucket shake frequency limiting unit 52 to EPC current determination unit 54. A control signal based on the command flow rate shown in FIG. 8 is output from EPC current determination unit 54 to electromagnetic proportional control valves 24 and 25.

When the bucket shake is performed, the operator normally repeats the manipulation of bucket control lever 42 by the maximum amount to move bucket 31 in the tilt direction and the manipulation of bucket control lever 42 by the maximum amount to move bucket 31 in the dump direction. In FIG. 8, at time T1, the operator starts to manipulate, in the tilt direction, bucket control lever 42 at the neutral position. When the amount of manipulation in the tilt direction becomes maximum at time T2, the operator immediately reduces the amount of manipulation in the tilt direction. When the amount of manipulation in the tilt direction becomes zero at time T3 and bucket control lever 42 is brought into a neutral state, the operator directly starts the manipulation in the dump direction. When the amount of manipulation in the dump direction becomes maximum at time T4, the operator immediately reduces the amount of manipulation in the dump direction.

The command flow rate of the hydraulic oil indicated by the solid line in FIG. 8 is controlled to come close to the target flow rate indicated by the dashed line. The rate of change in the flow rate of the hydraulic oil supplied to bucket cylinder 35 is limited, and the slope of the line graph of the command flow rate indicated by the solid line in FIG. 8 is limited. At time T1, the manipulation of bucket control lever 42 is started, and the command flow rate of the hydraulic oil also starts to increase, but the command flow rate is smaller than the target flow rate. Even when the amount of manipulation of bucket control lever 42 starts to decrease at time T2, the command flow rate is still smaller than the target flow rate, and thus, the command flow rate continues to increase. The command flow rate continues to increase until the command flow rate becomes equal to the target flow rate at time T5. Since the target flow rate becomes smaller than the command flow rate after time T5, the command flow rate decreases so as to come close to the target flow rate.

The amount of manipulation by the operator in the tilt direction becomes zero at time T3, and the command flow rate continues to decrease also after time T3. At the point in time when the command flow rate in the tilt direction becomes zero at time T6, bucket control lever 42 has been manipulated in the dump direction and the target flow rate in the dump direction has been calculated, and thus, the command flow rate of the hydraulic oil also starts to increase in the dump direction. Even if the amount of manipulation of bucket control lever 42 starts to decrease at time T4, the command flow rate is still smaller than the target flow rate, and thus, the command flow rate continues to increase. The command flow rate continues to increase until the command flow rate becomes equal to the target flow rate at time T7. Since the target flow rate becomes smaller than the command flow rate after time T7, the command flow rate decreases so as to come close to the target flow rate.

By controlling the command flow rate as described above, an amplitude A of the command flow rate shown in FIG. 8 is smaller than the amplitude of the target flow rate calculated based on the contents of the operator's manipulation of bucket control lever 42. Thus, the amount by which bucket 31 moves decreases. The operator can notice that the amplitude of the operation of bucket 31 is small and thereby recognize that manipulation of bucket control lever 42 is too fast.

Figure 9:
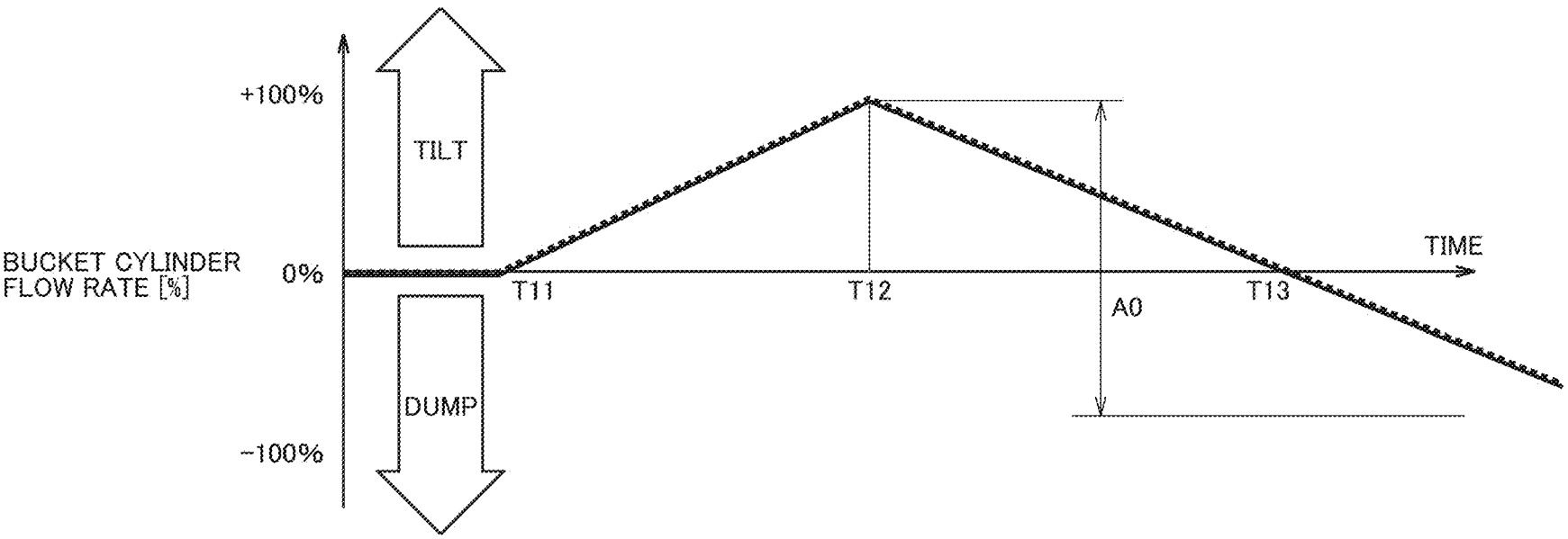
FIG. 9 is a diagram showing the flow rate of the hydraulic oil supplied to the bucket cylinder during an operation to vibrate a bucket at a low speed.

FIG. 9 is a diagram showing the flow rate of the hydraulic oil supplied to bucket cylinder 35 during the operation to vibrate the bucket at a low speed. Similarly to FIG. 8, in FIG. 9, the horizontal axis represents time while the vertical axis represents the flow rate of the hydraulic oil supplied to bucket cylinder 35. A dashed line in FIG. 9 indicates the target flow rate of the hydraulic oil determined by the operator's manipulation of bucket control lever 42, and a solid line in FIG. 8 indicates the command flow rate of the hydraulic oil after the rate of change in the flow rate of the hydraulic oil has been limited.

In the example shown in FIG. 8, due to the limitation on the rate of change in the flow rate of the hydraulic oil, the command flow rate of the hydraulic oil deviates from the target flow rate thereof, and the amplitude of the command flow rate decreases, but the command flow rate does not necessarily deviate from the target flow rate. Since the limitation on the rate of change in the flow rate of the hydraulic oil defines the upper limit of the rate of change, the rate of change can be set to be smaller than the limited rate of change.

In the example shown in FIG. 9, the operator manipulates bucket control lever 42 at a low speed, and the rate of change in the target flow rate of the hydraulic oil calculated based on the contents of manipulation of bucket control lever 42 is smaller than the limited rate of change in the command flow rate. In this case, the command flow rate after limitation applied on the rate of change in flow rate becomes equal to the target flow rate. An amplitude A0 of the command flow rate shown in FIG. 9 becomes equal to the amplitude of the target flow rate. In this way, when the operator manipulates bucket control lever 42 at a low speed, bucket 31 can be reciprocated as manipulated by the operator. Thereby, the control for limiting the rate of change in the flow rate of the hydraulic oil is prevented from hindering the excavation operation.

<Functions and Effects>

The following is a summary of the characteristic configuration and the functions and effect of the above-described embodiment.

As shown in FIG. 4, work implement controller 10 receives an input of the result of detection by frame angle sensor 47 that detects a relative position between rear frame 2B and front frame 2A. Work implement controller 10 controls the operation of bucket cylinder 35 based on the result of detection about the relative position between rear frame 2B and front frame 2A. Work implement controller 10 limits the operation of bucket cylinder 35 based on the result of detection about the relative position between rear frame 2B and front frame 2A.

In the articulated state in which front frame 2A is bent with respect to rear frame 2B, the operation of bucket 31 is limited. According to the magnitude of the articulation angle, the limit value of the movement of bucket 31 is changed to reduce the amplitude of bucket 31. Thereby, since the reaction force acting on rear frame 2B can be reduced, the swing of rear frame 2B in the roll direction can be reduced, and thus, resonance between the vibrations of bucket 31 and the swing of rear frame 2B can be suppressed. Therefore, the load applied to the structure including the vehicular body frame and the exterior can be reduced, so that the life of the structure can be lengthened.

Cab 5 is mounted on rear frame 2B, and the operator who is seated inside cab 5 manipulates wheel loader 1. The swing of rear frame 2B in the roll direction can be reduced, and thereby, the body of the operator inside cab 5 can be prevented from swinging to the left and right, so that the operator's fatigue can be reduced.

On the other hand, when the operator remotely manipulates wheel loader 1, the operator is not seated inside cab 5, which makes it difficult for the operator to feel how much the vehicular body swings. Even in the case of the work machine designed to be remotely manipulated, it is possible to limit such fast bucket shake as to apply a load to the structure of the vehicular body, and thereby, the life length of the structure can be enhanced.

In the case where the manipulation device includes a steering lever for bending front frame 2A with respect to rear frame 2B and the operator tilts this steering lever to the left or right to bend front frame 2A, this steering lever also undergoes acceleration in the left or right direction when rear frame 2B swings to the left or right. At this time, the bending of front frame 2A with respect to rear frame 2B may unintentionally change. Further, when the operator performs a manipulation to tilt the lever to the left or right for the operation of bucket 31, this lever also undergoes acceleration in the left or right direction when rear frame 2B swings to the left or right, which raises the possibility that vibrations of bucket 31 may continue despite the operator's intention. When the swing of rear frame 2B in the roll direction can be reduced, the swing of the lever in the left-right direction can be suppressed, which makes it possible to suppress occurrence of the operation of wheel loader 1 different from that of the operator's intention.

As shown in FIG. 6, as the articulation angle of bending of front frame 2A with respect to rear frame 2B is larger, work implement controller 10 may set the allowable number of times per unit time of the operation to vibrate bucket 31 to be smaller by limiting this allowable number of times per unit time. Thereby, in the state of traveling straight at a small articulate angle, the bucket shake is allowed to enable quick removal of adhering matter from bucket 31. The maximum frequency at which bucket control lever 42 can be manipulated for bucket shake is changed according to the articulation angle, and the bucket shake is limited when the articulation angle is large, and thereby, the swing of the vehicular body in the roll direction can be reduced, and the load applied to the vehicular body can be reduced.

As shown in FIG. 7, as a method of limiting the allowable number of times per unit time of the operation to vibrate bucket 31, work implement controller 10 may limit the rate of change in the flow rate of the hydraulic oil supplied to bucket cylinder 35. By limiting the rate of change in the flow rate of the hydraulic oil for causing bucket cylinder 35 to extend and retract, the acceleration of bucket 31 can be limited, and thereby, the bucket shake can be reliably limited.

As shown in FIG. 7, work implement controller 10 may set the rate of change in the flow rate of the hydraulic oil supplied to bucket cylinder 35 to be smaller as the articulation angle is larger. This makes it possible to limit the bucket shake operation when the articulation angle is large, and thus, the swing of the vehicular body in the roll direction can be reliably reduced.

As shown in FIG. 2, work implement controller 10 receives an input of contents of the operator's manipulation of bucket control lever 42 to operate bucket 31. As shown in FIG. 8, work implement controller 10 may limit the operation of bucket cylinder 35 according to the contents of manipulation of bucket control lever 42. In the articulated state, when the operator performs a rapid manipulation to vibrate bucket 31, bucket 31 is prevented from being operated as bucket control lever 42 is manipulated. T Thereby, the bucket shake can be limited to reduce the amplitude of bucket 31.

As shown in FIG. 8, work implement controller 10 may set the command flow rate of the hydraulic oil actually supplied to bucket cylinder 35 to be smaller than the target flow rate of the hydraulic oil to bucket cylinder 35 that is calculated based on the contents of manipulation of bucket control lever 42. By controlling the command flow rate to follow the target flow rate of the hydraulic oil and limiting the rate of change in the command flow rate, the amplitude of bucket 31 during the bucket shake can be reduced.

<Other Modifications>

The above description of the embodiment provides an example in which the rates of change in the flow rates are equally limited in four cases where the flow rate of the hydraulic oil increases and decreases in the tilt direction, and the flow rate of the hydraulic oil increases and decreases in the dump direction, but the rates of change in the flow rates may be differently limited. For example, the allowable value of the rate of change in the flow rate may be set to be smaller when the flow rate of the hydraulic oil increases in the tilt direction and the dump direction than when the flow rate of the hydraulic oil decreases in the tilt direction and the dump direction. When the flow rate of the hydraulic oil increases in the tilt direction and the dump direction, the rate of change in the flow rate may be limited. On the other hand, when the flow rate of the hydraulic oil decreases in the tilt direction and the dump direction, the flow rate of the hydraulic oil may be decreased according to the operator's manipulation of bucket control lever 42 without limiting the rate of change in the flow rate.

The above description of the embodiment provides, as a method of limiting the allowable number of times per unit time of the operation to vibrate bucket 31, an example in which work implement controller 10 limits the rate of change in the flow rate of the hydraulic oil supplied to bucket cylinder 35, but the present invention is not limited to this example. In place of bucket shake frequency limiting unit 52 shown in FIG. 4, a low-pass filter for the manipulation of bucket control lever 42 may be applied. By changing the cutoff frequency of the low-pass filter according to the articulation angle, more specifically, by setting the cutoff frequency to be lower as the articulation angle is larger, the bucket shake operation can be limited when the articulation angle is large, and thus, the swing of the vehicular body in the roll direction can be reliably reduced.

Alternatively, a control operation may be performed to measure the manipulation cycle of bucket control lever 42, and when the manipulation at a certain frequency or higher is detected, to stop bucket 31. The manipulation frequency for bucket control lever 42 as a threshold value at which bucket 31 is stopped may be changed according to the articulation angle. By limiting the maximum frequency at which bucket 31 can be manipulated when the articulation angle is large, the swing of the vehicular body in the roll direction can be reliably reduced.

The work machine to which the concept of the present disclosure is applicable is not limited to a wheel loader, but may be other types of work machines such as an offset boom-type or a swing-style boom-type hydraulic excavator in which a bucket can be moved to the left and right with respect to a revolving frame.

Second Embodiment

The first embodiment has been described with reference to an example in which the operator manipulates bucket control lever 42 to perform the bucket shake operation. In order to facilitate removal of adhering matter from bucket 31 by the bucket shake operation, a control operation is performed to automatically perform the bucket shake operation. When the operator inputs a manipulation to perform automatic bucket shake, work implement controller 10 determines the command flow rate for bucket cylinder 35 so as to implement the bucket shake operation at the "predetermined automatic bucket shake frequency", and then determines the EPC current based on the command flow rate. Thereby, work implement controller 10 automatically implements the bucket shake operation without operator's manipulation of bucket control lever 42.

Figure 10:
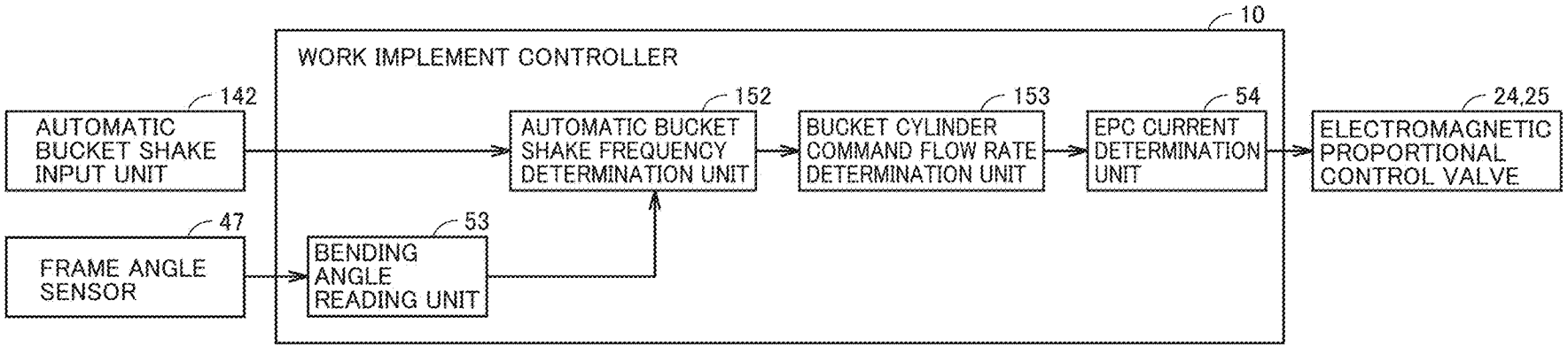
FIG. 10 is a block diagram showing a functional configuration of a work implement controller according to a second embodiment.

The second embodiment will be described with reference to the control for determining the "predetermined automatic bucket shake frequency" according to the articulation angle. FIG. 10 is a block diagram showing a functional configuration of a work implement controller 10 according to the second embodiment. Work implement controller 10 according to the second embodiment includes an automatic bucket shake frequency determination unit 152, a bucket cylinder command flow rate determination unit 153, bending angle reading unit 53, and EPC current determination unit 54.

An automatic bucket shake input unit 142 shown in FIG. 10 is configured, for example, of a switch or a touch panel. The operator manipulates automatic bucket shake input unit 142 to input a manipulation to perform the automatic bucket shake operation.

As in the first embodiment, bending angle reading unit 53 receives an input of a signal indicating the result of detection of the articulation angle from frame angle sensor 47. Bending angle reading unit 53 outputs the result of detection of the articulation angle to automatic bucket shake frequency determination unit 152.

When automatic bucket shake frequency determination unit 152 receives an input of the manipulation to perform the automatic bucket shake operation from automatic bucket shake input unit 142, it determines the frequency of the vibration of bucket 31 at the time of the automatic bucket shake operation based on the result of detection of the articulation angle. Specifically, automatic bucket shake frequency determination unit 152 changes the limit value of the movement of bucket 31 according to the magnitude of the articulation angle. More specifically, automatic bucket shake frequency determination unit 152 sets the number of times that bucket 31 vibrates per unit time to be smaller as the articulation angle is larger.

For example, a plurality of combinations of the articulation angle and the value of the automatic bucket shake frequency corresponding to the articulation angle are stored in advance in work implement controller 10 as a table. Based on this table, automatic bucket shake frequency determination unit 152 determines the automatic bucket shake frequency corresponding to the articulation angle read by bending angle reading unit 53. When the articulation angle is different from the value defined in the table, linear interpolation is applied to determine a specific numerical value of the automatic bucket shake frequency.

Bucket cylinder command flow rate determination unit 153 determines the command flow rate of the hydraulic oil supplied to bucket cylinder 35, in which the command flow rate corresponds to the magnitude of the articulation angle. Then, bucket cylinder command flow rate determination unit 153 outputs the determined command flow rate to EPC current determination unit 54. EPC current determination unit 54 determines a control signal (an EPC current) corresponding to the command flow rate of the hydraulic oil supplied to bucket cylinder 35, and outputs the EPC current to electromagnetic proportional control valves 24 and 25 for bucket.

Third Embodiment

As an example of control for substantially preventing a fast bucket shake operation from being performed when the articulation angle is large, the first embodiment has been described with reference to an example in which the rate of change in the flow rate of the hydraulic oil supplied to bucket cylinder 35 is limited. As another embodiment, the third embodiment will be described with reference to an example in which the maximum flow rate of the hydraulic oil supplied to bucket cylinder 35 is limited.

FIG. 11 is a diagram showing a maximum allowable flow rate of hydraulic oil supplied to bucket cylinder 35 with respect to an articulation angle according to the third embodiment. A table shown in FIG. 11 is stored in advance in work implement controller 10, the table including maximum allowable flow rates of the hydraulic oil supplied to bucket cylinder 35 at the articulation angles of 0 degree, 20 degrees, and 40 degrees. As the articulation angle is larger, the maximum allowable flow rate of the hydraulic oil supplied to bucket cylinder 35 is set to be smaller. In the state of traveling straight at an articulate angle of 0 degree, the maximum allowable flow rate of the hydraulic oil is set at a "large" value as a relatively large level. When the articulation angle is 20 degrees as a medium level, the maximum allowable flow rate of the hydraulic oil is set at an "intermediate" value as a medium level. When the articulation angle is 40 degrees as a maximum level, the maximum allowable flow rate of the hydraulic oil is set at a "small" value as a relatively small level.

In practice, specific numerical values are stored in advance in work implement controller 10, the specific numerical values including the maximum allowable flow rate of the hydraulic oil at articulation angles of 0 degree, 20 degrees, and 40 degrees. In the case where the articulation angle is greater than 0 degree and less than 20 degrees and is greater than 20 degrees and less than 40 degrees, linear interpolation is applied to determine the specific numerical values of the maximum allowable flow rate of the hydraulic oil.

Figure 12:
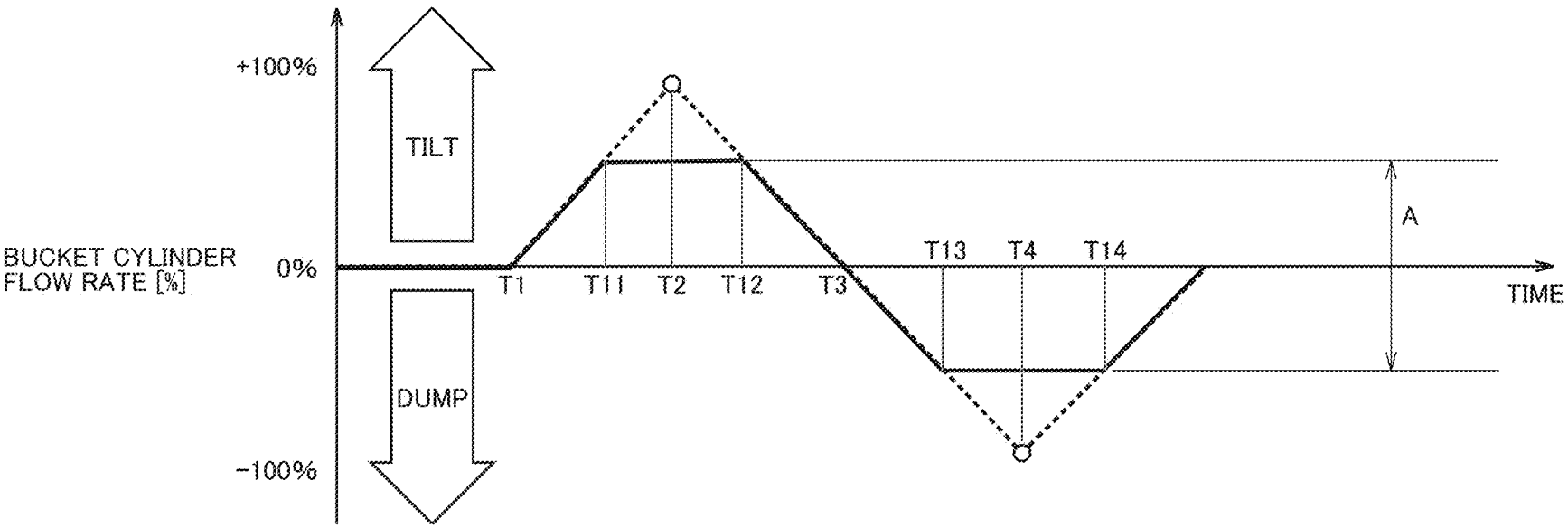
FIG. 12 is a diagram showing a flow rate of hydraulic oil supplied to the bucket cylinder during a bucket shake operation according to the third embodiment.

FIG. 12 is a diagram showing a flow rate of hydraulic oil supplied to bucket cylinder 35 during a bucket shake operation according to the third embodiment. As in FIG. 8 described in the first embodiment, in FIG. 11, the horizontal axis represents time while the vertical axis represents the flow rate of the hydraulic oil supplied to bucket cylinder 35. In FIG. 11, "0%" indicates the state in which the supply of hydraulic oil to bucket cylinder 35 is in a standstill. The positive direction of the vertical axis in FIG. 11 indicates the flow rate of the hydraulic oil at which bucket 31 is moved in the tilt direction. The negative direction of the vertical axis in FIG. 11 indicates the flow rate of the hydraulic oil at which bucket 31 is moved in the dump direction.

A dashed line in FIG. 11 indicates a target flow rate of the hydraulic oil determined by the operator's manipulation of bucket control lever 42. A solid line in FIG. 11 indicates the command flow rate of the hydraulic oil after the flow rate of the hydraulic oil has been limited. A control signal based on the command flow rate shown in FIG. 11 is output from EPC current determination unit 54 to electromagnetic proportional control valves 24 and 25.

At time T1, the operator starts to manipulate, in the tilt direction, bucket control lever 42 at the neutral position. When the amount of manipulation in the tilt direction becomes maximum at time T2, the operator immediately reduces the amount of manipulation in the tilt direction. When the amount of manipulation in the tilt direction becomes zero at time T3 and bucket control lever 42 is brought into a neutral state, the operator directly starts the manipulation in the dump direction. When the amount of manipulation in the dump direction becomes maximum at time T4, the operator immediately reduces the amount of manipulation in the dump direction.

In the third embodiment, the maximum allowable flow rate of the hydraulic oil supplied to bucket cylinder 35 is limited. At time T11, the target flow rate of the hydraulic oil determined by the input of bucket control lever 42 increases to the maximum allowable flow rate in the tilt direction. After time T11, the target flow rate becomes larger than the maximum allowable flow rate, but also in this case, the command flow rate is limited to the maximum allowable flow rate. Since the target flow rate decreases to the maximum allowable flow rate at time T12, the command flow rate is kept equal to the target flow rate after time T12. At time T13, the target flow rate increases to the maximum allowable flow rate in the dump direction. The target flow rate is larger than the maximum allowable flow rate from time T13 to time T14, but also in this case, the command flow rate is limited to the maximum allowable flow rate.

By controlling the command flow rate in this way, amplitude A of the command flow rate shown in FIG. 11 is smaller than the amplitude of the target flow rate calculated based on the contents of the operator's manipulation of bucket control lever 42.

When the articulation angle is large, the maximum allowable flow rate of the hydraulic oil is limited to limit the amplitude of the operation to vibrate bucket 31, so that the maximum speed of bucket 31 can be reduced. Thereby, the bucket shake operation at a high speed can be limited.

It should be understood that the embodiments disclosed herein are illustrative and non-restrictive in every respect. The scope of the present invention is defined by the scope of the claims, rather than the description above, and is intended to include any modifications within the meaning and scope equivalent to the scope of the claims.

REFERENCE SIGNS LIST

1 wheel loader, 2 vehicular body frame, 2A front frame, 2B rear frame, 3 work implement, 5 cab, 7 traveling unit, 7A, 7B running wheel, 10 work implement controller, 11 engine, 21 hydraulic pump, 22 bucket control valve, 23 boom control valve, 24, 25, 26, 27 electromagnetic proportional control valve, 31 bucket, 32 boom, 33 bell crank, 34 coupling link, 35 bucket cylinder, 36 boom cylinder, 41 boom control lever, 42 bucket control lever, 44 boom angle sensor, 45 bucket angle sensor, 46 boom bottom pressure sensor, 47 frame angle sensor, 51 bucket cylinder target flow rate calculation unit, 52 bucket shake frequency limiting unit, 53 bending angle reading unit, 54 EPC current determination unit, 142 automatic bucket shake input unit, 152 automatic bucket shake frequency determination unit, 153 bucket cylinder command flow rate determination unit.

The invention claimed is:

1. A control system for a work machine, the control system comprising:

a rear frame;

a front frame connected to the rear frame to be bendable with respect to the rear frame;

a bucket that is operable with respect to the front frame;

an actuator that drives the bucket;

a sensor that detects an angle at which the front frame is bent with respect to the rear frame; and a controller that controls the actuator, wherein the controller receives an input of a result of detection by the sensor and controls an operation of the actuator to vibrate the bucket based on the result of detection.

2. The control system for a work machine according to claim 1, wherein the controller limits the operation of the actuator based on the result of detection.

3. The control system for a work machine according to claim 2, wherein the controller limits an allowable number of times per unit time of an operation to vibrate the bucket.

4. The control system for a work machine according to claim 3, wherein the controller sets the allowable number of times per unit time of the operation to vibrate the bucket to be smaller as the angle at which the front frame bends with respect to the rear frame is larger.

5. The control system for a work machine according to claim 2, wherein the actuator includes a bucket cylinder that receives supply of hydraulic oil to drive the bucket, and the controller limits a rate of change in a flow rate of the hydraulic oil supplied to the bucket cylinder.

6. The control system for a work machine according to claim 5, wherein the controller sets the rate of change in the flow rate of the hydraulic oil supplied to the bucket cylinder to be smaller as the angle at which the front frame bends with respect to the rear frame is larger.

7. The control system for a work machine according to claim 2, wherein the controller limits an amplitude of an operation to vibrate the bucket.

8. The control system for a work machine according to claim 2, further comprising a manipulation device that is operable manually to operate the bucket, wherein the controller limits the operation of the actuator according to contents of manipulation of the manipulation device.

9. The control system for a work machine according to claim 8, wherein the actuator includes a bucket cylinder that receives supply of hydraulic oil to drive the bucket, and the controller sets a flow rate of hydraulic oil supplied to the bucket cylinder to be smaller than a flow rate of hydraulic oil calculated based on the contents of manipulation.

10. The control system for a work machine according to claim 8, wherein the work machine includes a cab mounted on the rear frame or the front frame, an operator being seated inside the cab, and the manipulation device is disposed inside the cab.

11. The control system for a work machine according to claim 1, wherein the work machine includes a rear wheel attached to the rear frame and a front wheel attached to the front frame.

12. A control method for a work machine, the work machine including a rear frame, a front frame connected to the rear frame to be bendable with respect to the rear frame, a bucket that is operable with respect to the front frame, an actuator that drives the bucket, and a sensor that detects an angle at which the front frame is bent with respect to the rear frame, the control method comprising:

receiving an input of a result of detection by the sensor; and controlling an operation of the actuator to vibrate the bucket based on the result of detection.

* * * * *